US007880685B2

(12) United States Patent
Norvell et al.

(10) Patent No.: US 7,880,685 B2
(45) Date of Patent: Feb. 1, 2011

(54) SWITCHED-RESONANCE ANTENNA PHASE SHIFTER AND PHASED ARRAY INCORPORATING SAME

(75) Inventors: Bill R. Norvell, Red Oak, TX (US); Robert A. York, Santa Barbara, CA (US); Michael P. Grace, Santa Barbara, CA (US)

(73) Assignee: Toyon Research Corporation, Goleta, CA (US)

( * ) Notice: Subject to any disclaimer, the term of this patent is extended or adjusted under 35 U.S.C. 154(b) by 33 days.

(21) Appl. No.: 10/950,514

(22) Filed: Sep. 28, 2004

(65) Prior Publication Data

US 2005/0073461 A1 Apr. 7, 2005

Related U.S. Application Data

(60) Provisional application No. 60/507,515, filed on Oct. 2, 2003.

(51) Int. Cl.
*H01Q 3/24* (2006.01)

(52) U.S. Cl. ..... 343/876; 343/700 MS

(58) Field of Classification Search ..... 343/700 MS, 343/853, 858, 876; 342/372
See application file for complete search history.

(56) References Cited

U.S. PATENT DOCUMENTS 4,947,178 A * 8/1990 Shafai ..... 343/700 MS
5,294,939 A 3/1994 Sanford et al.
5,434,575 A 7/1995 Jelinek et al.
5,714,961 A * 2/1998 Kot et al. ..... 343/769
5,936,595 A 8/1999 Wang
6,133,882 A 10/2000 LaFleur et al.
6,184,828 B1 * 2/2001 Shoki ..... 342/372
6,252,553 B1 * 6/2001 Solomon ..... 343/700 MS
2001/0040530 A1 11/2001 Livingston et al.
2003/0179138 A1 9/2003 Chen
2003/0193446 A1 10/2003 Chen
2003/0219035 A1 11/2003 Schmidt

OTHER PUBLICATIONS

"IEEE Standard Definitions of Terms for Antennas", IEEE Std 145-1993.
*Antenna Engineering Handbook*, 2nd edition, Richard C. Johnson and Henry Jasik, eds. (2001).
Coleman, et al., "A Compact Flush-Mounting Antenna with Direction Finding and Steerable Cardioid Pattern Capability," *IEEE Transactions on Antennas and Propagation*, vol. AP-32, No. 4, pp. 412-414 (Apr. 1984).
Morishita, et al., "Analysis of a Cavity-Backed Annular Slot Antenna with One Point Shorted," *IEEE Transactions on Antennas and Propagation*, vol. 39, No. 10, pp. 1472-1478 (Oct. 1991).
Garg, et al., *Microstrip Antenna Design Handbook*, pp. 470-480 (2001).

* cited by examiner

*Primary Examiner*—Michael C Wimer
(74) *Attorney, Agent, or Firm*—Nixon & Vanderhye PC

(57) ABSTRACT

Controlled phase shift in the operation of an RF antenna element is achieved by selectively choosing between different modes of antenna element resonance. Additional phase control resolution is achieved by combining this with other types of phase shifters. Such phase shifters are especially useful within a phased array of RF antenna radiator elements.

24 Claims, 4 Drawing Sheets

SWITCHED-RESONANCE ANTENNA PHASE SHIFTER AND PHASED ARRAY INCORPORATING SAME

RELATED APPLICATIONS

This non-provisional application claims the priority benefit under 35 U.S.C. §119(e) of provisional application 60/507,515 filed Oct. 2, 2003, the entire content of which is hereby incorporated by reference.

BACKGROUND OF THE INVENTION

1. Field of the Invention

The present invention relates to the field of antennas. Specifically, it relates to phase-controlled antennas including phased arrays.

2. Related Art

Array antennas refer to the class of antennas which provide radiation formed by phase-coherent combining of outputs from (or inputs to) multiple antenna elements. The antenna characteristics are determined by the spatial position of individual radiators and the amplitudes, phases, and time delays of their respective excitation(s). Advantages provided by array antennas include the ability to control the radiation and reception pattern of an antenna by changing the excitation across the array aperture. For example, the antenna main beam can be very rapidly scanned without having to mechanically reposition the antenna. It also provides the ability to modify the pattern to suppress interference or to otherwise enhance the spatial coverage which the antenna is to provide.

In many array applications, the relative phase response at each element is controlled via a device called a phase shifter. Different types of phase shifters rely on various physical mechanisms to effect a change in phase response. At microwave frequencies, phase shifters are typically implemented as switched lengths of transmission line (e.g., strip line) or resonant circuits, the former implementation having a larger bandwidth than the latter.

In the past, switching between different antenna element feed ports has been used to select elements of multi-element antennas, to control element gain, to adjust the antenna element impedance, and to change the polarization response of the antenna. To our knowledge, switched feeds on the same antenna element have never been used to achieve controlled phase shifts nor has varactor-based selection between plural modes of antenna resonance been used to implement controlled phase shifts. The most closely related prior art in our present view (U.S. Pat. No. 5,434,575) describes a relatively complex, multi-element antenna that switches among pairs of antenna elements for selectively changing the sense of circularly polarized antenna operation.

It is assumed that the reader will have a general background in RF circuits and antennae. However, if not, for general background information reference may be had to texts such as, for example:

Hansen, R. C., *Phased Array Antennas*, John Wiley & Sons, 1998

Kraus, J. D., and Marhefka, R. J., *Antennas for All Applications*, McGraw-Hill, 2002

Pozar, D. M., *Microwave Engineering*, Addison Wesley, 1993.

BRIEF SUMMARY OF THE INVENTION

This invention achieves controlled phase shifted antenna element operation by selectively choosing between different modes of antenna element resonance.

An exemplary embodiment implements a very simple phase shift with minimal insertion loss and minimal circuit complexity. The exemplary embodiment may be referred to as a one-bit (180 degree) phase shifter since the controllable phase states for a given antenna element are separated by $360°/2^n$, where n is the number of bits in the digital word used to command a particular phase state (e.g., from a phased array controller). Though the present exemplary embodiment is limited to one-bit phase resolution at each antenna element, its use in combination with switched-transmission-line (or other) phase shifter designs reduces average loss over phase states by eliminating the longest (0°/180°) path (or element) otherwise required in a standard phase shifter (which longest path has the highest loss) and by reducing the size and number of circuit elements in the accompanying combined conventional phase shifter(s) required to implement a complete digitally controlled phase shifter of arbitrary resolution.

The present exemplary embodiment may also be, at the elemental level, substantially simpler than the polarization control approach of U.S. Pat. No. 5,434,575 in that only a single antenna element and pair of switches is required, reducing mass (important for ultra-lightweight satellite applications), eliminating complex switch matrix and hybrid circuitry, and permitting phase shifting of arbitrarily polarized signals. The feed switches may also require less circuit area than switched delay lines or resonant phase-shifters, thus reducing cost in highly integrated, single-chip transmit/receive module designs.

BRIEF DESCRIPTION OF THE DRAWINGS

Other objects and advantages of this invention will become more apparent from a detailed study of the following detailed description of exemplary embodiments taken in conjunction with the accompanying drawings, in which.

DETAILED DESCRIPTION OF EXEMPLARY EMBODIMENTS

Figure 1:
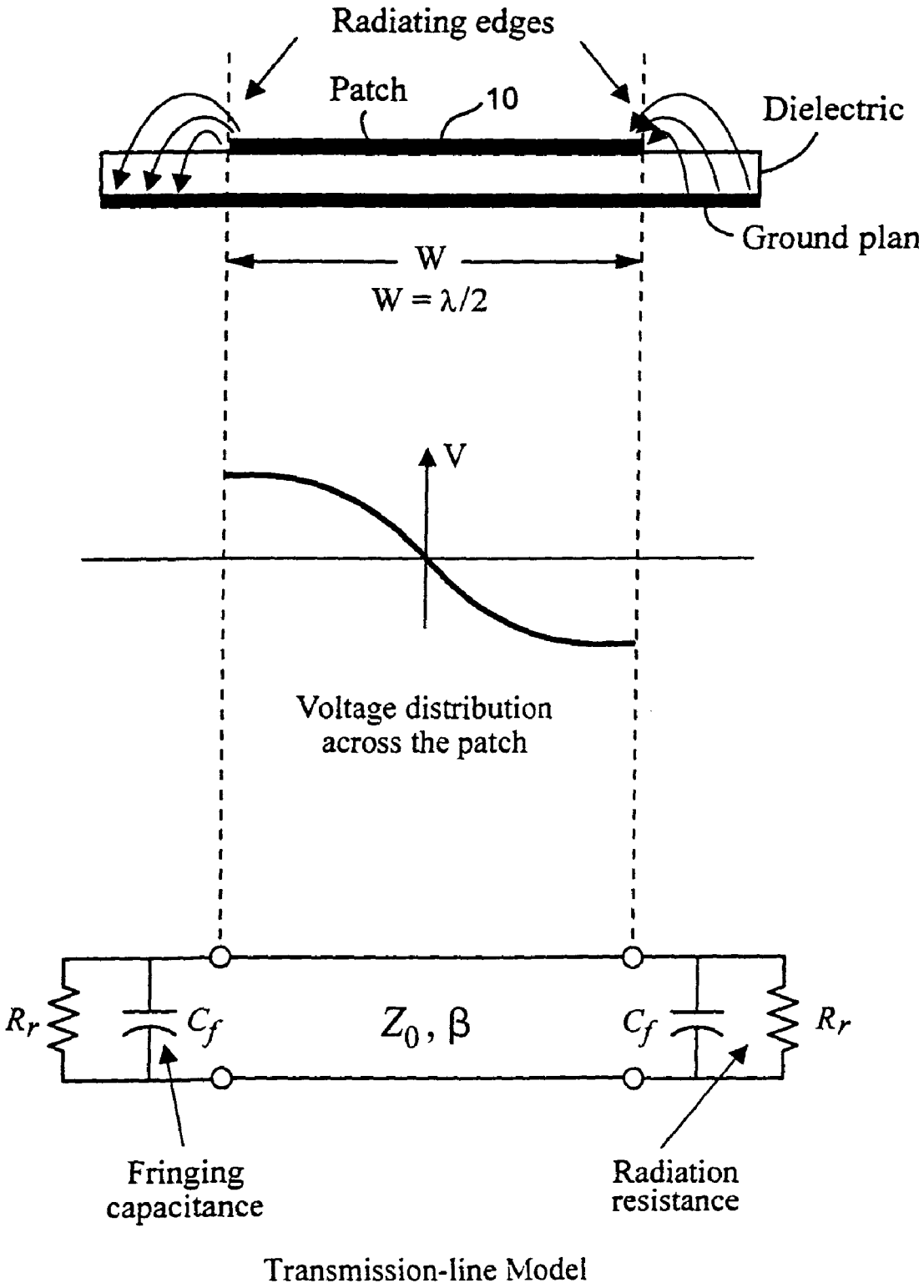
FIG. 1 depicts, respectively, a cross-sectional diagram of a half-wavelength patch antenna above a ground plane, the voltage distribution across the patch and an equivalent circuit model of the patch.

Referring now to the drawings, which are intended to illustrate only a presently preferred exemplary embodiment and not to in any way limit the scope of this invention, a one-bit (180°) phase shifter is implemented as a switched feed to a single antenna element 10 such as a microstrip patch antenna element as shown in cross section at FIG. 1. Those in the art will appreciate that the patch effectively defines a 3D volume underlying a 2D conductive patch (i.e., the patch 10 has a resonant half-wavelength width W and also has a length dimension extending orthogonal to the plane of FIG. 1). The response of a patch antenna can be viewed as a half-wavelength resonator with an equivalent circuit model as shown in FIG. 1. In response to an impinging plane wave of the proper wavelength, the voltage from the patch to the ground plane as a function of distance in the E-plane across the patch as shown in FIG. 1.

Figure 2A:
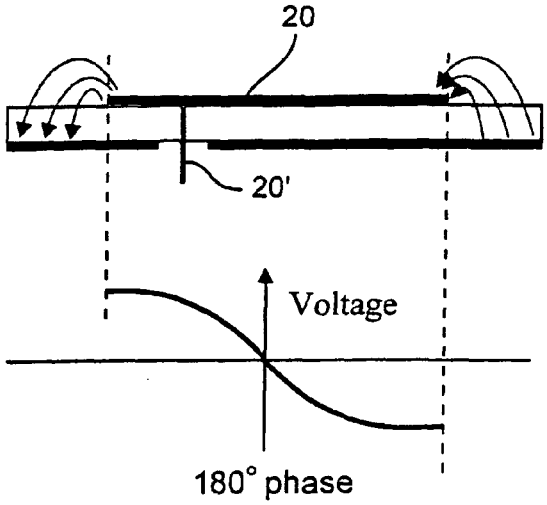
FIGS. 2*a* and 2*b* are, respectively, cross-sectional diagrams of two probe-fed patches with equal but opposite offset locations of the feed probe (and the resulting voltage distribution indicating a phase reversal, i.e., a 180° relative phase shift) while FIG. 2*c* schematically depicts a single patch having the offset feed points of both FIGS. 2*a* and 2*b;*
Figure 2B:
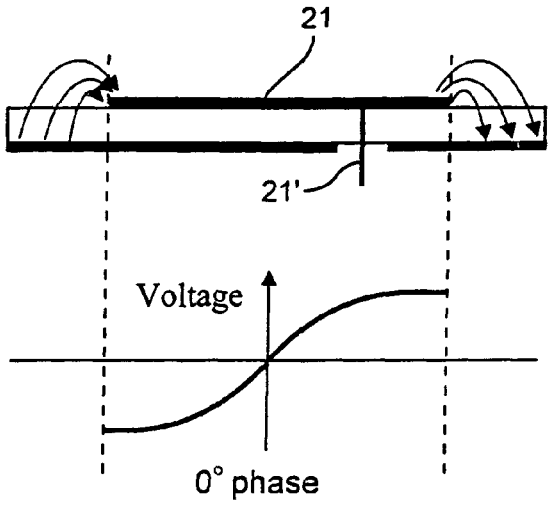
Figure 2C:
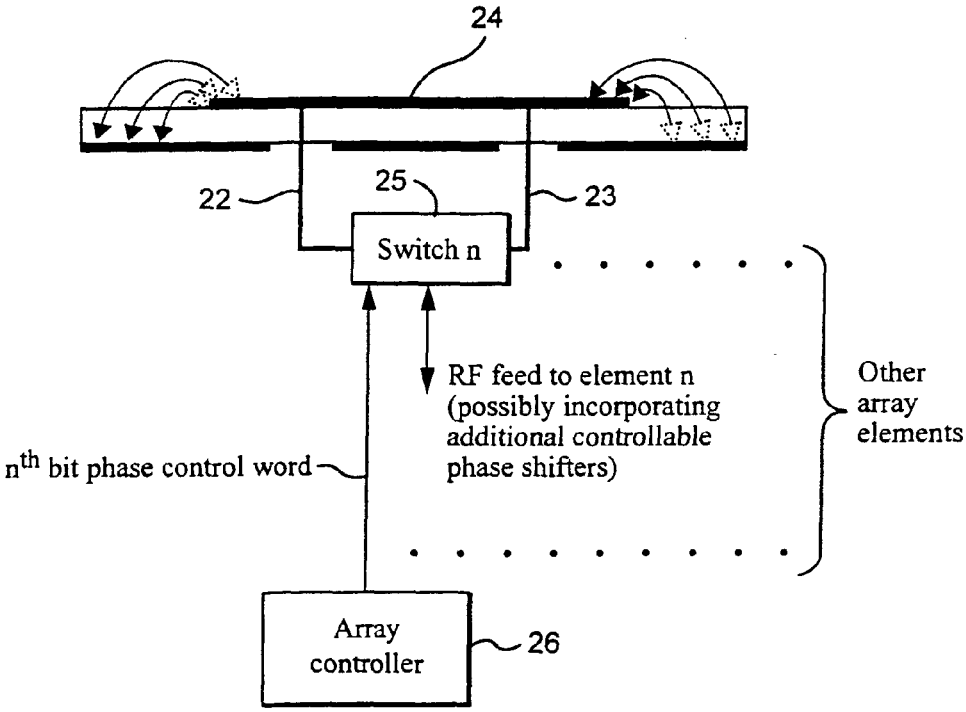
Figure 3A:
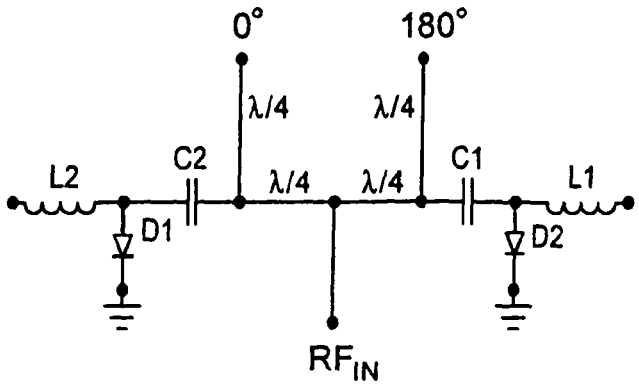
FIGS. 3*a*-3*d* are a set of circuit diagrams showing different possible switch configurations including, respectively, PIN diode shunt, PIN diode series, MEMS (micro electromechanical systems) switch shunt, MEMS switch series.
Figure 3B:
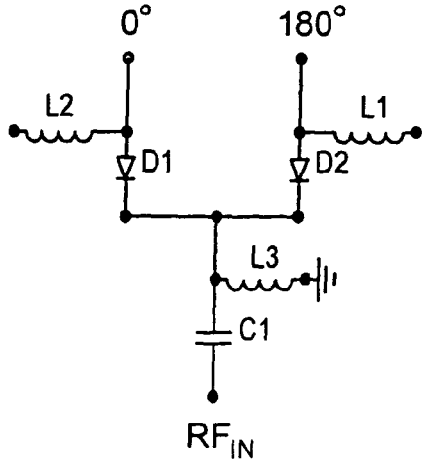
Figure 3D:
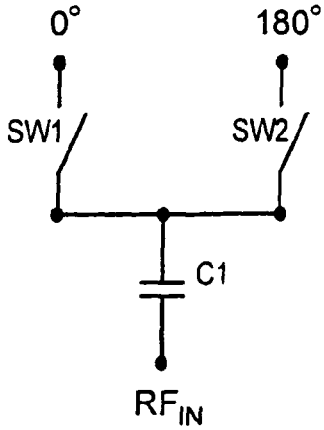
Figure 3C:
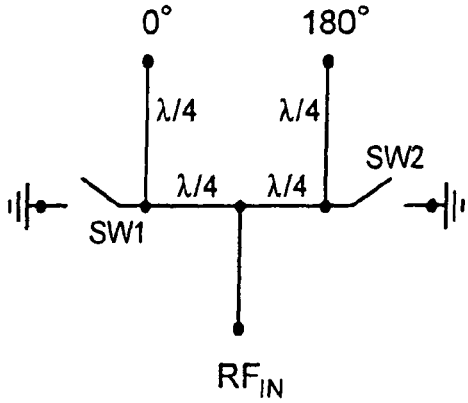

FIGS. 2*a* and 2*b* show a pair of patch radiator elements 20, 21 being fed via offset probes 20' and 21' where the offset from center of the patches is the same distance, but in opposite directions (in the E-plane). Although depicted with internal bottom feed points, those in the art will also understand that microstrip radiators may be edge fed (e.g., using microstrip feed lines in the plane of the patch). Note that the two feed points 20' and 21' are located symmetrically about the center of the respective patches 20, 21. The impedance of the patch antenna as seen at each of the feed points is the same in both cases, but the voltage distribution phase response is changed by 180°. Selection of a particular feed (e.g., to one of two such feeds 22, 23 on a single patch 24 as depicted in FIG. 2*c*) may be accomplished via a switch 25 controlled by array controller 26. As previously noted, additional auxiliary phase shifters (e.g., of conventional switched transmission line types) may be combined with this simple 180° one-bit phase shifter at each element to achieve arbitrary phase shifting resolution as desired.

A variety of switching methods may be used, depending on frequency, to route the RF signal to the desired one of plural feeds. Therefore, the general technique is not frequency limited. The switching methods include, but are not limited to, varactor diodes, PIN diodes, and MEMS in different circuit configurations. FIGS. 3*a*-3*d* show some of these switch control configurations.

In order to minimize RF insertion loss and digital phase shifter circuit complexity, the present exemplary embodiment may incorporate dual feed points connected via varactor diodes. Controlling the capacitance of these two varactors modifies the resonant response of the antenna resulting in the desired 180° phase shift. The required capacitance swing can be as low as 3:1 so that the varactors are not real switches in the usual sense (i.e., to effectively physically connect or disconnect electrical conductors), rather they act to modify the resonant behavior of the antenna.

Figure 4:
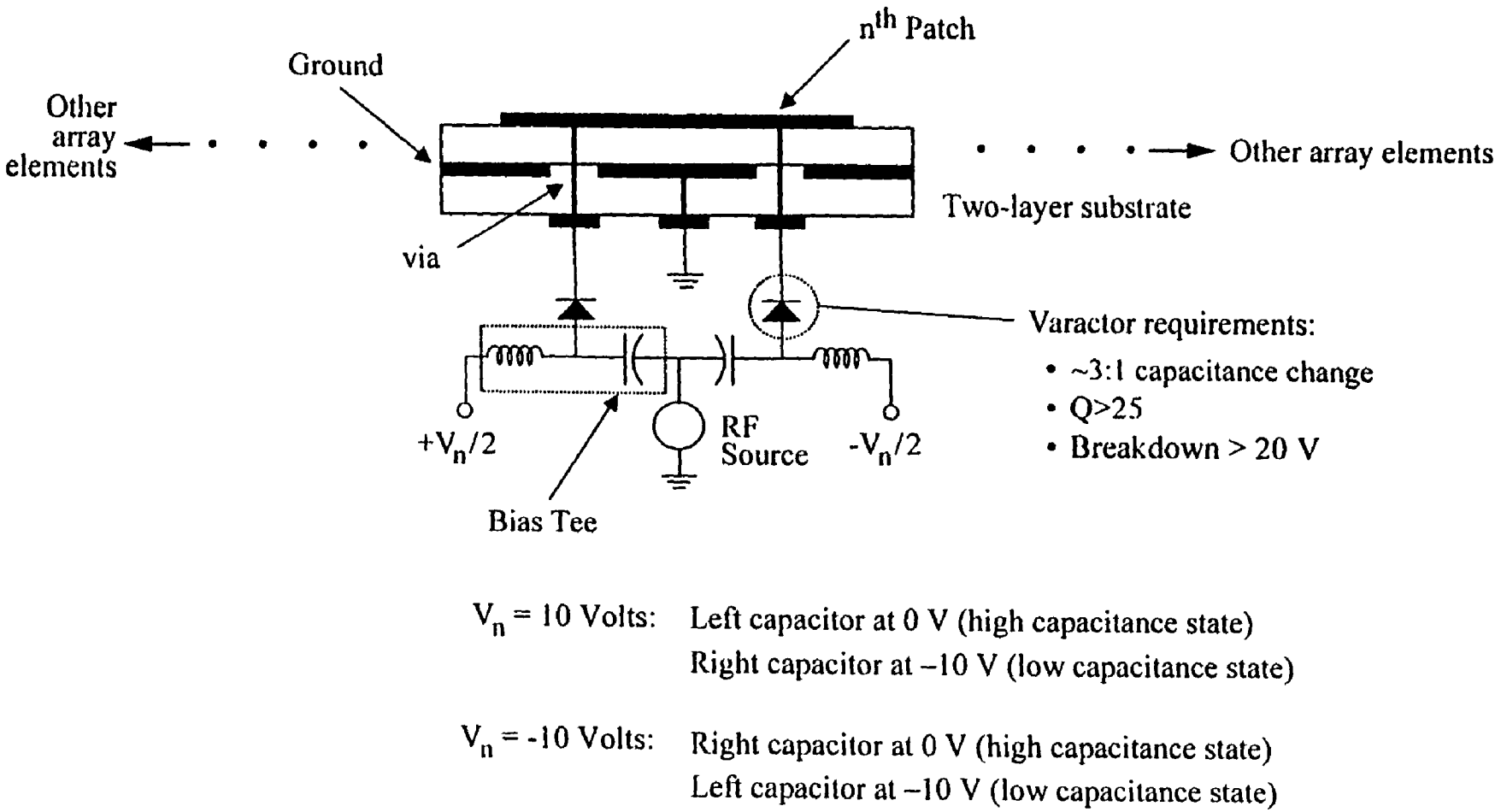
FIG. 4 depicts a presently preferred exemplary embodiment for a one-bit (180 degree) phase shifter implemented using varactor diodes to modify the phase response of the antenna element where the design frequency for this example is 10 GHz (for other frequencies, the capacitance, capacitance swing, and bias circuitry values would be adjusted).

An exemplary switching circuit is shown in FIG. 4. This switch architecture utilizes a pair of varactor diodes whose capacitance, capacitance swing, and bias circuitry are adjusted so that both of the diodes act as an on/off switch at the designed radio frequency of the antenna. The control bit voltage $V_n$ for this stage of the array is applied in such a way that only one of the diode switches is in the high capacitance state at any time.

While the probe-fed patch antenna element discussed thus far is presently a preferred mode of practice, the present exemplary embodiments also contemplate use of other feed techniques such as aperture coupling, co-planar microstrip feeds, and strip line feeds. Similarly, other antenna elements can be substituted for the patch example described above. These other antenna elements include dipoles, flared notches, slots, and any other antenna that supports balanced 0°/180° modes. Such exemplary embodiments may be aptly described as employing a switched resonance, one-bit (180 degree) antenna phase shifter.

It will be appreciated that this invention may be combined with other switched antenna element control features. For example, both polarization and one-bit phase shift control can be achieved by using a pair of properly situated feed points for each 0°, 180° relative phase control thus providing two different possible polarizations for each phase shift value.

This invention has been described in connection with one or more exemplary embodiments. However, those skilled in the art will readily appreciate that many modifications and variations may be made to these exemplary embodiments while yet retaining novel features and advantages. Accordingly, all such modifications and variations are intended to be covered by the following claims.

What is claimed:

1. An RF antenna phase shifter comprising:

a single antenna radiating element having plural feed points symmetrically disposed with respect to said radiating element and respectively associated with corresponding plural selectable resonant modes of operation which modes all have the same polarization, wherein a signal received or transmitted by each one of said modes differs from another of said modes substantially only by a constant electrical phase shift; and a controllable circuit connected to said feed points to selectively cause a corresponding selected single one of said resonant modes of operation to occur.

2. An RF antenna phase shifter as in claim 1 further comprising:

a controllable further phase shift circuit connected in series with said single antenna radiating element to achieve greater overall controllable phase shifting resolution.

3. An array of plural RF antenna phase shifters, each phase shifter comprising:

a single antenna radiating element having plural feed points symmetrically disposed with respect to said radiating element and respectively associated with corresponding plural selectable resonant modes of operation, wherein a signal received or transmitted by each one of said modes differs from another of said modes only by a constant electrical phase shift; and a controllable circuit connected to said feed points to selectively cause a corresponding selected single one of said resonant modes of operation to occur, wherein the single antenna radiating elements of the plural phase shifters also act as antenna elements of a phased array of plural antenna elements across an array aperture and further comprising:

an array controller providing digital phase control signals to said controllable circuits.

4. A method for providing controlled phase shifts in the operation of an RF antenna element, said method comprising:

providing a single antenna radiating element having plural feed points symmetrically disposed with respect to said radiating element and respectively associated with corresponding plural selectable resonant modes of operation which modes all have the same polarization, wherein a signal received or transmitted by each one of said modes differs from another of said modes substantially only by a constant electrical phase shift; and selectively feeding said feed points to cause a selected single one of said resonant modes of operation to occur.

5. A method as in claim 4 further comprising:

selectively causing a further controllable phase shift in series with said single antenna radiating element to achieve greater overall controllable phase shifting resolution.

6. A method for providing a controllable phased array comprising a method for providing controlled phase shifts in the operation of an RF antenna element, said method comprising:

providing a single antenna radiating element having plural feed points symmetrically disposed with respect to said radiating element and respectively associated with corresponding plural selectable resonant modes of operation, wherein a signal received or transmitted by each one of said modes differs from another of said modes only by a constant electrical phase shift; and selectively feeding said feed points to cause a selected single one of said resonant modes of operation to occur, wherein plural of the single antenna radiating elements of respectively corresponding phase shifters also act as antenna elements of a phased array of plural antenna elements across an array aperture and further comprising:

providing digital phase control signals for each said radiating element to effect said selectively causing step.

7. An antenna phase shifter comprising:

a single radiating antenna element having two selectable resonant modes of operation respectively corresponding to two separated feed ports, each said resonant mode differing from the other only by being shifted by 180 degrees in phase with respect to the other; and a controllable RF switch connected to switch an RF feed line between said feed ports so as to feed only a single port at any given time in dependence upon an electrical control signal thereby achieving a 0°/180° relative phase shift in antenna element operation depending upon which feed port is being used.

8. An antenna phase shifter as in claim 7 further comprising:

a controllable further phase shifter connected in series with said antenna element to achieve greater overall controllable phase shifting resolution.

9. An antenna phase shifter as in claim 8 wherein:

said RF antenna element comprises a microstrip patch having two half-wavelength resonant modes across at least one dimension of the patch.

10. An antenna phase shifter as in claim 9 wherein:

said separated feed points are disposed at internal points disposed between the element and an underlying ground plane at positions symmetrically offset from a center of the element.

11. An antenna phase shifter as in claim 7 wherein:

said separated feed points are disposed at internal points disposed between the element and an underlying ground plane at positions symmetrically offset from a center of the element.

12. An antenna phase shifter as in claim 9 wherein:

said controllable RF switch comprises a first varactor connected to a first of said feed ports and a second varactor connected to a second of said feed ports, said varactors also being dc-connected to separate respective control signal ports and RF-connected to a common RF feed port.

13. An antenna phase shifter as in claim 12 wherein said control signal ports are configured to supply oppositely-valued varactor bias control signals to said varactors corresponding to an input element bias control signal thereby controlling said varactors to respectively switch between alternate states depending upon corresponding alternate input element bias control signal states.

14. An array of plural antenna phase shifters as in any of claims 7, 8, 9, 10, 11, 12 or 13 wherein the antenna elements of the phase shifters also act as antenna elements of a phased array across an array aperture and further comprising:

an array controller providing a respectively corresponding plurality of binary-valued phase control bits, a highest order one of said bits being connected to control the phase of a respectively corresponding one of said antenna elements.

15. A method for providing controlled phase shifts in the operational mode of an antenna element, said method comprising:

providing a single radiating antenna element having two selectable resonant modes of operation respectively corresponding to two separated feed ports, each said resonant mode differing from the other only by being shifted by 180 degrees in phase with respect to the other; and controllably switching an RF feed line between different ones of said two feed ports in dependence upon an electrical control signal thereby achieving a 0°/180° relative phase shift in antenna element operation depending upon which feed port has been connected to said feed line.

16. A method as in claim 15 further comprising:

selectively causing a further controlled phase shift in series with said antenna element to achieve greater overall controllable phase shifting resolution.

17. A method as in claim 16 wherein:

said RF antenna element comprises a microstrip patch having two half-wavelength resonant modes across at least one dimension of the patch.

18. A method as in claim 17 wherein:

said separated feed points are disposed at internal points disposed between the element and an underlying ground plane at positions symmetrically offset from a center of the element.

19. A method as in claim 15 wherein:

said separated feed points are disposed at internal points disposed between the element and an underlying ground plane at positions symmetrically offset from a center of the element.

20. A method as in claim 17 wherein:

said controllably switching step is achieved using a first varactor connected to a first of said feed ports and a second varactor connected to a second of said feed ports, said varactors also being dc-connected to separate respective control signal ports and RF-connected to a common RF feed port.

21. A method as in claim 20 wherein said control signal ports are configured to supply oppositely-valued varactor bias control signals to said varactors corresponding to an input element bias control signal thereby controlling said varactors to respectively switch between alternate states depending upon corresponding alternate input element bias control signal states.

22. A method for providing a controllable phased array using a method as in any of claims 15, 16, 17, 18, 19, 20 or 21 for plural antenna phase shifters wherein the antenna elements of the phase shifters also act as antenna elements of a phased array across an array aperture and further comprising:

providing a corresponding plurality of binary-valued phase control bits, a highest order one of said bits being connected to control the phase of a respectively corresponding one of said antenna elements.

23. An array of plural RF antenna phase shifters, each phase shifter comprising:

a single antenna radiating element having plural feed points symmetrically disposed with respect to said radiating element and respectively associated with corresponding plural selectable resonant modes of operation, wherein a signal received or transmitted by each one of said modes differs from another of said modes only by a constant electrical phase shift;

a controllable circuit connected to said feed points to selectively cause a corresponding selected single one of said resonant modes of operation to occur; and a controllable further phase shift circuit connected in series with said single antenna radiating element to achieve greater overall controllable phase shifting resolution, wherein the single antenna radiating elements of the plural phase shifters also act as antenna elements of a phased array of plural antenna elements across an array aperture and further comprising:

an array controller providing digital phase control signals to said controllable circuits.

24. A method for providing a controllable phased array comprising a method for providing controlled phase shifts in the operation of an RF antenna element, said method comprising:

providing a single antenna radiating element having plural feed points symmetrically disposed with respect to said radiating element and respectively associated with corresponding plural selectable resonant modes of operation, wherein a signal received or transmitted by each one of said modes differs from another of said modes only by a constant electrical phase shift;

selectively feeding said feed points to cause a selected single one of said resonant modes of operation to occur; and selectively causing a further controllable phase shift in series with said single antenna radiating element to achieve greater overall controllable phase shifting resolution, wherein plural of the single antenna radiating elements of respectively corresponding phase shifters also act as antenna elements of a phased array of plural antenna elements across an array aperture and further comprising:

providing digital phase control signals for each said radiating element to effect said selectively causing step.

* * * * *